US007736441B2

(12) United States Patent
Outka et al.

(10) Patent No.: US 7,736,441 B2
(45) Date of Patent: Jun. 15, 2010

(54) CLEANING FIXTURES AND METHODS OF CLEANING ELECTRODE ASSEMBLY PLENUMS

(75) Inventors: Duane Outka, Fremont, CA (US); Bill Denty, San Jose, CA (US); Rajinder Dhindsa, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 359 days.

(21) Appl. No.: 11/869,340

(22) Filed: Oct. 9, 2007

(65) Prior Publication Data

US 2009/0090393 A1 Apr. 9, 2009

(51) Int. Cl.
*B08B 9/00* (2006.01)
*B08B 5/02* (2006.01)

(52) U.S. Cl. ..... 134/22.12; 134/22.1; 134/22.18

(58) Field of Classification Search ..... 134/22.1, 134/22.12, 22.18

See application file for complete search history.

(56) References Cited

U.S. PATENT DOCUMENTS 5,266,153 A 11/1993 Thomas
5,273,588 A 12/1993 Foster et al.
7,052,553 B1 5/2006 Shih et al.
7,247,579 B2 7/2007 Ren et al.
7,442,114 B2 10/2008 Huang et al.
7,498,269 B2 3/2009 Ren et al.
7,507,670 B2 3/2009 Shih et al.
7,578,889 B2 8/2009 Shih et al.
7,638,004 B1 12/2009 Shih et al.
2005/0133160 A1 6/2005 Kennedy et al.
2006/0090700 A1 5/2006 Satoh et al.
2008/0092920 A1 4/2008 Shih et al.
2008/0236618 A1 10/2008 Outka et al.

OTHER PUBLICATIONS

International Search Report and Written Opinion dated Jan. 28, 2009 pertaining to International application No. PCT/US2008/075675 filed Sep. 9, 2008.

*Primary Examiner*—Michael Kornakov
*Assistant Examiner*—Natasha Campbell
(74) *Attorney, Agent, or Firm*—Dinsmore & Shohl LLP

(57) ABSTRACT

According to one embodiment of the present invention, a method of cleaning one or more fluid plenums of an electrode assembly is provided. According to the method, a plurality of fluid ports in communication with the fluid plenum are isolated and differentiated into respective sets of plenum input ports and plenum output ports. The input and output ports are engaged with respective cleaning fluid couplings. A cleaning fluid is directed through the fluid plenum by creating a fluid pressure differential $\Delta P = P_{IN} - P_{OUT}$ across the plenum input and output ports. The pressure differential $\Delta P$ is large enough to force cleaning fluid from the cleaning fluid supply duct to the cleaning fluid waste duct through the fluid plenum. Additional embodiments are disclosed and claimed.

18 Claims, 2 Drawing Sheets

CLEANING FIXTURES AND METHODS OF CLEANING ELECTRODE ASSEMBLY PLENUMS

BACKGROUND

The present invention relates generally to plasma processing and plasma processing chamber components. More particularly, the present invention relates to methods of cleaning electrode assembly components containing plenums and to cleaning fixtures for facilitating these methods.

BRIEF SUMMARY

In general, plasma processing chambers are used to process substrates by a variety of techniques including, but not limited to, etching, physical vapor deposition, chemical vapor deposition, ion implantation, resist removal, etc. For example, and not by way of limitation, one type of plasma processing chamber contains an upper electrode, commonly referred to as a showerhead electrode, and a bottom electrode. An electric field is established between the electrodes to excite a process gas into the plasma state to process substrates in the reaction chamber.

Showerhead electrodes and other components of plasma processing chambers are commonly provided as assemblies of multiple components. Many of these components include plenums for directing or containing a process fluid or are configured to form fluid plenums in association with other components of an assembly. Regardless of the shape, size, or function of the particular fluid plenum at issue, the present inventors have recognized a significant need for improved methods and associated hardware for cleaning assemblies and components including fluid plenums.

According to one embodiment of the present invention, a method of cleaning one or more fluid plenums of an electrode assembly is provided. According to the method, a plurality of fluid ports in communication with the fluid plenum are isolated and differentiated into respective sets of plenum input ports and plenum output ports. The input and output ports are engaged with respective cleaning fluid couplings. A cleaning fluid is directed through the fluid plenum by creating a fluid pressure differential $\Delta P=P_{IN}-P_{OUT}$ across the plenum input and output ports. The pressure differential $\Delta P$ is large enough to force cleaning fluid from the cleaning fluid supply duct to the cleaning fluid waste duct through the fluid plenum.

In accordance with another embodiment of the present invention, a cleaning fixture for cleaning fluid plenums of an electrode assembly is provided. The cleaning fixture comprises one or more cleaning fluid supply ducts, one or more cleaning fluid waste ducts, and one or more cleaning fluid couplings. The cleaning fluid couplings of the cleaning fixture are configured to engage and form respective sealed interfaces with the input and output ports of a fluid plenum of an electrode assembly. The sealed interfaces formed by the cleaning fluid couplings are sufficient to permit a fluid pressure differential $\Delta P=P_{IN}-P_{OUT}$ to be created across the plenum input and output ports, wherein the fluid pressure differential $\Delta P$ is large enough to force cleaning fluid from the cleaning fluid supply duct to the cleaning fluid waste duct through the fluid plenum without exceeding the pressure differential failure threshold or the absolute pressure failure threshold of the sealed interfaces at the plenum fluid input and output ports.

Additional embodiments are disclosed and claimed.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which:

FIGS. 2 and 3 are schematic illustrations of relatively simple fluid plenum configurations and cleaning fixtures according to particular embodiments of the present invention engaged there with;

DETAILED DESCRIPTION

Figure 6:
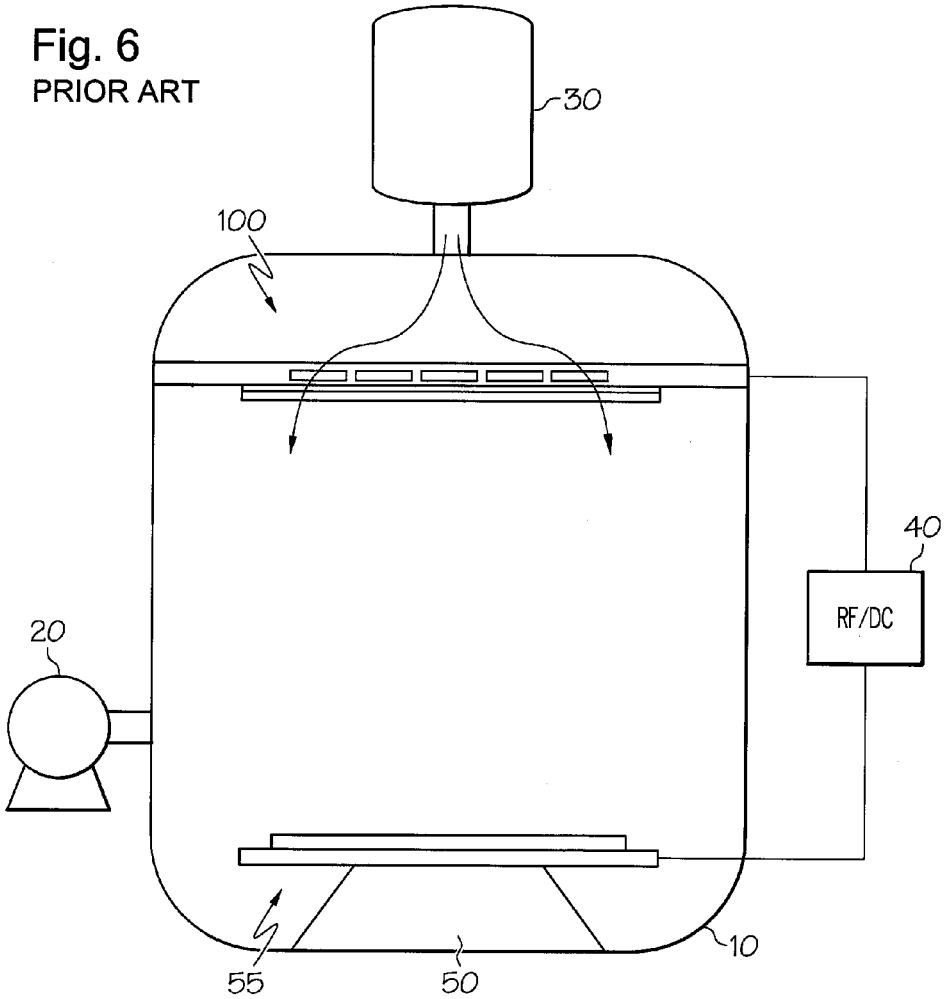
Fig. 6 PRIOR ART
FIG. 6 is a schematic illustration of a plasma processing chamber.

The various aspects of the present invention can be illustrated in the context of a plasma processing chamber 10, which is merely illustrated schematically in FIG. 6 to avoid limitation of the concepts of the present invention to particular plasma processing configurations, or components, that may not be integral to the subject matter of the present invention. As is generally illustrated in FIG. 6, the plasma processing chamber 10 comprises a vacuum source 20, a process gas supply 30, a plasma power supply 40, a substrate support 50 including a lower electrode assembly 55, and an upper electrode assembly 100.

Referring to FIGS. 1-6, generally, the electrode assembly 100 comprises a thermal control plate 110, a showerhead electrode 120, and an interface layer 130 for facilitating a secure bond between the thermal control plate 110 and the showerhead electrode 120. One or more fluid plenums 140 are provided in the thermal control plate 110 to direct process gas from the process gas supply 30 to showerhead electrode passages in the showerhead electrode 120. Although the present invention is not limited to particular thermal control plate or showerhead electrode configurations, it is noted that the plenums 140 in the thermal control plate 110 typically direct process gas from the backside of the electrode assembly 100 to an array of small holes provided along the frontside of the showerhead electrode 120, as is illustrated schematically by the directional process gas flow arrows in FIG. 6. It is also noted that a variety of teachings may be relied upon in the design of electrode assembly components including, but not limited to, U.S. Pub. No. 2005/0133160. Alternatively, or additionally, the thermal control plate 110, the showerhead electrode 120, or both, may comprise one or more sub-surface fluid plenums 140 that can be configured to provide for circulation of a heat transfer fluid in the electrode assembly to help control the temperature of the assembly.

The interface layer 130 is presented as an illustrative example and may comprise an adhesive bonding material, a thermally conductive gasket, or any other structure that facilitates assembly of the electrode assembly 100. It is contemplated that a variety of sealing members and securing hardware can be used to secure the thermal control plate 110 to the showerhead electrode 120. It is also contemplated that the securing hardware may also be selected to permit disengagement of the thermal control plate 110 and the showerhead electrode 120. In any event, the interface layer 130 and the general two-part structure of the electrode assembly 100 are presented for illustrative purposes only and should not be used to limit the scope of the present invention to any particular electrode assembly structure. Rather, cleaning fixtures and cleaning methods according to particular embodiments of the present invention typically only require the presence of some type of fluid plenum in an electrode assembly 100.

Figure 1:
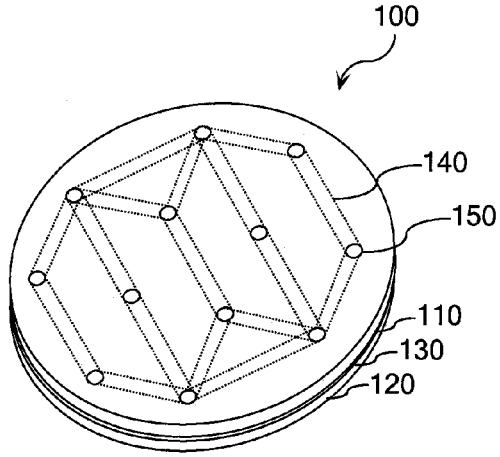
Fig. 1 PRIOR ART
FIG. 1 is an isometric view of an electrode assembly including a sub-surface fluid plenum.

More specifically, the electrode assemblies 100 illustrated schematically in FIGS. 1-5 each include one or more subsurface fluid plenums 140 and a plurality of fluid ports 150 in communication with the fluid plenums 140. The scope of the present invention should not be limited to the particular plenum configurations illustrated in FIGS. 1-5. The illustrated configurations are merely presented to illustrate the concepts of the present invention as they relate to plenum cleaning. Indeed, it is contemplated that the concepts of the present invention will be applicable to a variety of plenum configurations of varying complexity, including those where isolated fluid ports 150 are in communication with distinct portions of a common fluid plenum 140, as is illustrated in FIG. 1, or those where isolated fluid ports are in communication with independent fluid plenums.

Figure 2:
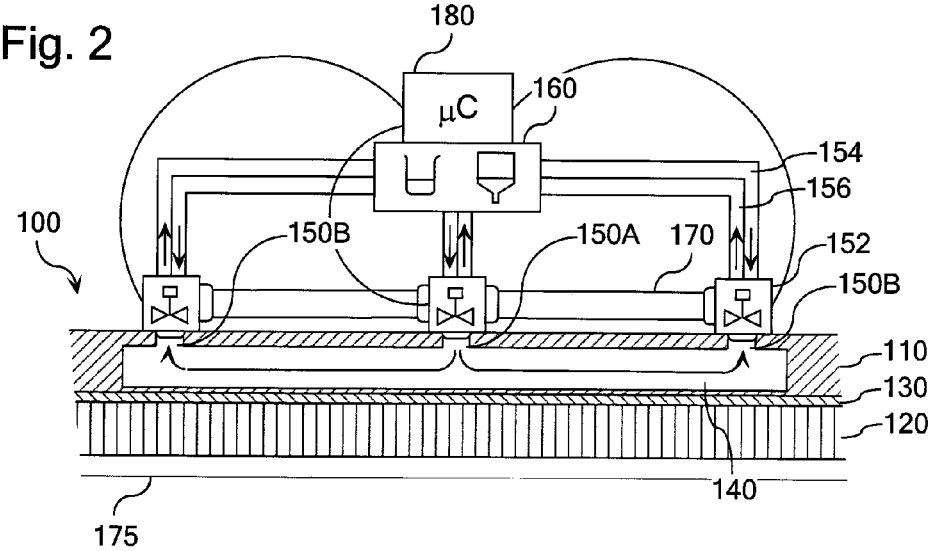

Referring to FIG. 2, according to one method of cleaning an electrode assembly according to the present invention, fluid ports are differentiated into respective sets of plenum input ports 150A and plenum output ports 150B. The input and output ports 150A, 150B are engaged with respective cleaning fluid couplings 152 that are configured to form a sealed interface with the port with which it is engaged. A cleaning fluid from a cleaning fluid reservoir 160 is directed through the fluid plenum 140 by providing one or more cleaning fluid supply ducts 154 in communication with the plenum input ports 150A and one or more cleaning fluid waste ducts 156 in communication with the plenum output ports 150B. The cleaning fluid supply 150 comprises a pump or some type of fluid pressure generating configuration and creates fluid pressure differential $\Delta P = P_{IN} - P_{OUT}$ across the plenum input and output ports 150A, 150B.

The pressure differential $\Delta P$ is large enough to force cleaning fluid from the cleaning fluid supply ducts 154 to the cleaning fluid waste ducts 156 through the fluid plenum 140. Care may also be taken to maintain the pressure differential $\Delta P$ below the pressure differential failure threshold of the sealed interfaces of the plenum fluid input and output ports 150A, 150B. In addition, it may also be preferable to maintain the respective pressures $P_{IN}$, $P_{OUT}$ at the plenum input and output ports 150A, 150B below the absolute pressure failure thresholds of the sealed input and output port interfaces. In this manner, cleaning fluid may be forcibly directed through the fluid plenum 140 while isolating the cleaning fluid exclusively to the fluid plenum. In addition, the nature of the cleaning process is such that the cleaning operation may be executed prior to, during, or following fabrication and construction of the electrode assembly 100. The forcible nature of the cleaning operation also reduces the likelihood that particles will remain trapped within the fluid plenum 140 and serve as a source of contamination in the plasma processing chamber 10 illustrated in FIG. 6.

Figure 3:
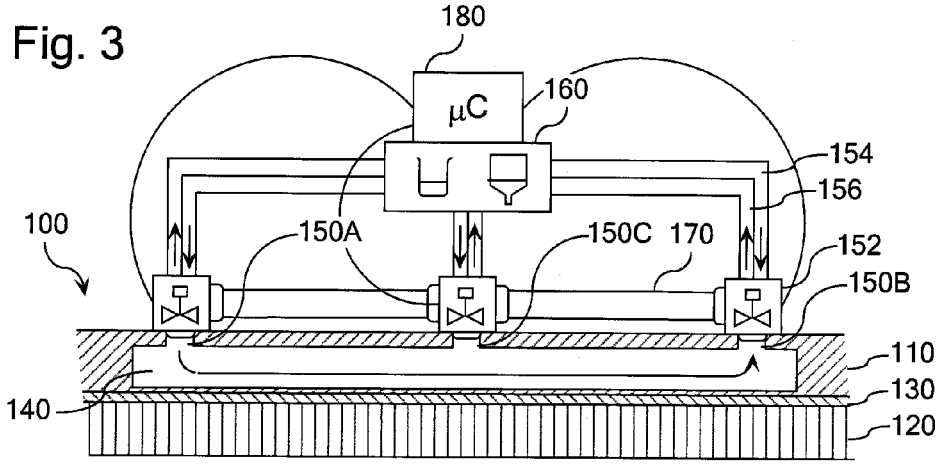

Referring to FIG. 3, it is noted that the fluid ports 150 can be further differentiated into a set of one or more closed plenum ports 150C to help tailor the cleaning fluid flow pattern within the fluid plenum 140, as is evident in comparing the directional arrows within the respective fluid plenums 140 of FIGS. 2 and 3. Indeed, it is contemplated that a variety of fluid flow patterns may be created by altering the respective positions of the plenum input ports 150A, the plenum output ports 150B, and the closed plenum ports 150C. Particular target patterns may be selected for creating an optimum distribution of the cleaning fluid within the fluid plenum 140.

Figure 4:
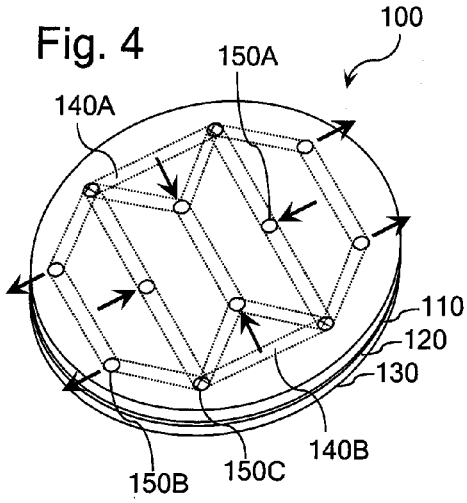
FIGS. 4 and 5 illustrate the manner in which alternative target cleaning fluid flow patterns can be created through variable designation of input, output, and closed plenum ports.
Figure 5:
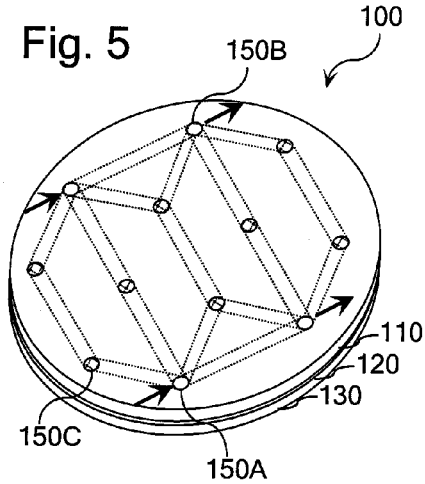

Referring to FIGS. 4 and 5, alternative target cleaning fluid flow patterns may be selected to cooperate with one or more subsequent cleaning fluid flow patterns to ensure adequate coverage of the various portions of a fluid plenum. For example, the cleaning fluid flow pattern defined by the plenum input ports 150A, the plenum output ports 150B, and the closed plenum ports 150C in FIG. 4 directs a significant amount of cleaning fluid through the majority of the plenum 140 but also tends to leave relatively inactive fluid plenum portions 140A, 140B, which may be insufficiently cleaned by the flow of cleaning fluid within the plenum 140. To accommodate for these types of flow pattern issues, it is contemplated that the cleaning fluid may be directed through the fluid plenum by varying the manner in which the fluid ports are differentiated into respective sets of input and output ports. More specifically, referring to FIG. 5, the respective locations of the plenum input ports 150A, the plenum output ports 150B, and the closed plenum ports 150C can be altered from those illustrated in FIG. 4 to direct cleaning fluid through the formerly inactive fluid plenum portions 140A, 140B before or after the cleaning operation illustrated in FIG. 4 is executed.

Referring again to FIGS. 2 and 3, the aforementioned variation in the manner in which the fluid ports 150 are differentiated into respective input, output, and closed ports can be executed by controlling respective valves associated with each cleaning fluid coupling 152. Alternatively, the variation in fluid port differentiation can be executed by using a programmable controller 180 to control a fluid router in communication with the cleaning fluid reservoir 160 and the cleaning fluid supply ducts 154. The cleaning fluid reservoir 160 is also illustrated in FIGS. 2 and 3 as a receptacle for used cleaning fluid.

According to one aspect of the present invention, the cleaning fluid can be directed through the fluid plenum 140 by interchanging the respective sets of input and output ports so as to execute at least one input/output port swapping operation characterized by a repeated series of back-and-forth, swapped cleaning pulses flowing through the fluid plenum 140. Similarly, it is contemplated that the cleaning fluid can be directed through the fluid plenum 140 at a varying flow rate to simulate a series of cleaning fluid pulses. Additionally, it is contemplated that the cleaning fluid can be directed through the fluid plenum 140 with a turbulence-generating gaseous medium, such as nitrogen or filtered air.

FIGS. 2 and 3 also illustrate the use of a cleaning fixture 170 to fix the relative positions of the engaged cleaning fluid couplings 152 and enable convenient transition of successive, similarly configured electrode assemblies 100 to a plenum cleaning station employing the cleaning fixture 170 and the associated cleaning fluid couplings 152. In this context, it may not be necessary to use respective valves associated with each cleaning fluid coupling 152 or to use a programmable controller 180 to control a fluid router in communication with the cleaning fluid reservoir 160 and the cleaning fluid supply ducts 154 because the respective positions of the input, output and closed plenum ports 150A, 150B, 150C can be established and maintained as the successive electrode assemblies are cleaned. Indeed, once a preferred cleaning fluid flow pattern is established, it may be sufficient to provide the cleaning fixture 170 as a plate that can be attached to the backside of the electrode assembly 100. In which case, the plate would have appropriate channels which would either block a particular plenum port or allow fluid to enter/exit a particular plenum port. In the event successive electrode assemblies do not employ comparable fluid port geometries, it is contemplated that the cleaning fixture 170 can be configured to permit the respective positions of the fixed cleaning fluid couplings 152 to be varied to match those of the fluid ports 150.

As is noted above, in many cases the process gas from the backside of the electrode assembly 30 is directed to an array of small holes provided along the frontside of the showerhead electrode 120. In this context, it will often be preferable to provide a cleaning fixture blocking plate 175 configured to prevent the dispersal or loss of cleaning fluid through the array of process gas holes in the showerhead electrode 120 to help maintain the integrity and precision of the cleaning operation.

It is noted that recitations herein of a component of the present invention being "configured" to embody a particular property or function in a particular manner are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present invention or to emphasize alternative or additional features that may or may not be utilized in a particular embodiment of the present invention.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the open-ended preamble term "comprising."

What is claimed is:

1. A method of cleaning one or more fluid plenums of an electrode assembly, the method comprising:

isolating a plurality of fluid ports in communication with the fluid plenum;

differentiating the fluid ports into respective sets of one or more plenum input ports and one or more plenum output ports;

engaging the input and output ports with respective cleaning fluid couplings, wherein each of the cleaning fluid couplings is configured to form a sealed interface with the port with which it is engaged;

directing a cleaning fluid through the fluid plenum by providing one or more cleaning fluid supply ducts in communication with the plenum input ports and one or more cleaning fluid waste ducts in communication with the plenum output ports and creating a fluid pressure differential $\Delta P = P_{IN} - P_{out}$ across the plenum input and output ports, wherein the cleaning fluid is directed through the fluid plenum by varying the manner in which the fluid ports are differentiated into respective sets of input and output ports;

the pressure differential $\Delta P$ is large enough to force cleaning fluid from the cleaning fluid supply duct to the cleaning fluid waste duct through the fluid plenum, the pressure differential $\Delta P$ is maintained below the pressure differential failure threshold of the sealed interfaces at the plenum fluid input and output ports, and the respective pressures $P_{IN}$, $P_{out}$ at the plenum input and output ports are maintained below the absolute pressure failure thresholds of the sealed interfaces at the plenum input and output ports.

2. A method as claimed in claim 1 wherein the variation in fluid port differentiation is executed by controlling respective valves associated with each cleaning fluid coupling.

3. A method as claimed in claim 1 wherein the variation in fluid port differentiation is executed through a fluid router in communication with a cleaning fluid reservoir and the cleaning fluid supply ducts.

4. A method as claimed in claim 1 wherein:

the cleaning fluid is directed through the fluid plenum by varying the manner in which the fluid ports are differentiated into respective sets of input plenum ports, output plenum ports, and closed plenum ports; and the variation in fluid port differentiation is executed by controlling respective valves associated with each cleaning fluid coupling or by using a fluid router in communication with the cleaning fluid supply ducts.

5. A method as claimed in claim 1 wherein the cleaning fluid is directed through the fluid plenum by varying the manner in which the fluid ports are differentiated into respective sets of input and output ports so as to vary the cleaning fluid flow pattern in the fluid plenum.

6. A method as claimed in claim 1 wherein the cleaning fluid is directed through the fluid plenum by interchanging the respective sets of input and output ports so as to execute at least one input/output port swapping operation.

7. A method as claimed in claim 6 wherein the input/output port swapping operation is executed as a repeated series of swapped cleaning pulses.

8. A method as claimed in claim 1 wherein the cleaning fluid is directed through the fluid plenum by varying the manner in which the fluid ports are differentiated into respective sets of input and output ports so as to vary the cleaning fluid flow pattern in the fluid plenum and by interchanging the respective sets of input and output ports so as to execute at least one input/output port swapping operation.

9. A method as claimed in claim 1 wherein the fluid ports are further differentiated into a set of one or more closed plenum ports.

10. A method as claimed in claim 1 wherein the isolated fluid ports are in communication with distinct portions of a common fluid plenum.

11. A method as claimed in claim 1 wherein the isolated fluid ports are in communication with independent fluid plenums.

12. A method as claimed in claim 1 wherein the fluid ports are differentiated into respective sets of one or more plenum input ports and one or more plenum output ports according to a target cleaning fluid flow pattern.

13. A method as claimed in claim 1 wherein the cleaning fluid is directed through the fluid plenum at a varying flow rate simulating a series of cleaning fluid pulses.

14. A method as claimed in claim 1 wherein the cleaning fluid is directed through the fluid plenum with a turbulence-generating gaseous medium.

15. A method as claimed in claim 1 wherein the relative positions of the engaged cleaning fluid couplings are at least temporarily fixed using a cleaning fixture.

16. A method as claimed in claim 15 wherein the method further comprises directing the cleaning fluid through an additional fluid plenum using the fixed cleaning fluid couplings of the cleaning fixture.

17. A method as claimed in claim 15 wherein the method further comprises directing the cleaning fluid through an additional fluid plenum by adjusting the fixed cleaning fluid couplings of the cleaning fixture.

18. A method of cleaning one or more fluid plenums of an electrode assembly, the method comprising:

isolating a plurality of fluid ports in communication with the fluid plenum;

differentiating the fluid ports into respective sets of one or more plenum input ports and one or more plenum output ports;

engaging the input and output ports with respective cleaning fluid couplings, wherein each of the cleaning fluid couplings is configured to form a sealed interface with the port with which it is engaged;

directing a cleaning fluid through the fluid plenum by providing one or more cleaning fluid supply ducts in communication with the plenum input ports and one or more cleaning fluid waste ducts in communication with the plenum output ports and creating a fluid pressure differential $\Delta P=_{IN-Pout}$ across the plenum input and output ports, wherein the pressure differential $\Delta P$ is large enough to force cleaning fluid from the cleaning fluid supply duct to the cleaning fluid waste duct through the fluid plenum, the pressure differential $\Delta P$ is maintained below the pressure differential failure threshold of the sealed interfaces at the plenum fluid input and output ports, the respective pressures $P_{IN,\ Pout}$ at the plenum input and output ports are maintained below the absolute pressure failure thresholds of the sealed interfaces at the plenum input and output ports;

the relative positions of the engaged cleaning fluid couplings are at least temporarily fixed using a cleaning fixture; and the method further comprising preventing the dispersal or loss of cleaning fluid through process gas holes in the showerhead electrode by utilizing a cleaning fixture blocking plate.

* * * * *

UNITED STATES PATENT AND TRADEMARK OFFICE

CERTIFICATE OF CORRECTION

PATENT NO. : 7,736,441 B2
APPLICATION NO. : 11/869340
DATED : June 15, 2010
INVENTOR(S) : Outka et al.

It is certified that error appears in the above-identified patent and that said Letters Patent is hereby corrected as shown below:

Col. 8, Line 6, Claim 18 - "$\Delta P = P_{IN\ -Pout}$" should read -- $\Delta P = P_{IN} - P_{OUT}$ --;

Col. 8, Line 15, Claim 18 - "$P_{IN}, {}_{Pout}$" should read -- $P_{IN}, P_{OUT}$ --.

Signed and Sealed this

Fifth Day of October, 2010

David J. Kappos

David J. Kappos
*Director of the United States Patent and Trademark Office*